US009472140B2

(12) United States Patent
Kanda et al.

(10) Patent No.: US 9,472,140 B2
(45) Date of Patent: Oct. 18, 2016

(54) DRIVE CIRCUIT, OPTOELECTRONIC DEVICE, ELECTRONIC DEVICE, AND DRIVE METHOD

(71) Applicant: SAMSUNG DISPLAY CO., LTD., Yongin, Gyeonggi-Do (KR)

(72) Inventors: Eiji Kanda, Yokohama (JP); Takeshi Okuno, Yokohama (JP); Naoaki Komiya, Yokohama (JP)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 49 days.

(21) Appl. No.: 14/514,879

(22) Filed: Oct. 15, 2014

(65) Prior Publication Data

US 2015/0029238 A1 Jan. 29, 2015

Related U.S. Application Data

(63) Continuation of application No. PCT/JP2013/061230, filed on Apr. 15, 2013.

(30) Foreign Application Priority Data

Apr. 16, 2012 (JP) ..... 2012-092666

(51) Int. Cl.
*G09G 3/32* (2016.01)

(52) U.S. Cl.
CPC ..... *G09G 3/325* (2013.01); *G09G 3/3233* (2013.01); *G09G 3/3291* (2013.01); *G09G 3/3266* (2013.01); *G09G 2300/0439* (2013.01); *G09G 2300/0842* (2013.01); *G09G 2310/027* (2013.01); *G09G 2310/0251* (2013.01); *G09G 2310/0262* (2013.01);

(Continued)

(58) Field of Classification Search
CPC combination set(s) only.
See application file for complete search history.

(56) References Cited

U.S. PATENT DOCUMENTS

2010/0253708 A1* 10/2010 Kasai ..... G09G 3/3258 345/690
2011/0032282 A1* 2/2011 Kasai ..... G09G 3/3258 345/690
2011/0279049 A1* 11/2011 Kawabe ..... G09G 3/3233 315/228

FOREIGN PATENT DOCUMENTS

JP 10-253987 9/1998
JP 2008-170788 7/2008

(Continued)

OTHER PUBLICATIONS

International Search Report for PCT/JP2013/061230 filed on Apr. 15, 2013; Eiji Kanda, et al.

*Primary Examiner* — Dwayne Bost
*Assistant Examiner* — Robert Michaud
(74) *Attorney, Agent, or Firm* — Lee & Morse P.C.

(57) ABSTRACT

A device includes pixel circuits arranged in columns and rows, n data lines (n being an integer of 2 or more) for each column, gate lines supplied with scan signals, and light-emitting control lines supplied with light-emitting control signals. The pixel circuits are divided into n groups of rows, each group of rows being exclusively connected to a corresponding data line. Each pixel circuit includes a write control transistor to control writing a data voltage in response to a scan signal, a driving transistor to control the amount of current to be supplied to a current light-emitting element, a light-emitting control transistor to control supply of a current to the light-emitting element in response to a light-emitting control signal, a capacitor to retain a voltage corresponding to a write data voltage, and a reset transistor to set the gate electrode of the driving transistor with the initial voltage.

15 Claims, 14 Drawing Sheets

(52) U.S. Cl.
CPC ..... *G09G 2310/0272* (2013.01); *G09G 2310/0297* (2013.01); *G09G 2320/0233* (2013.01); *G09G 2320/0626* (2013.01)

(56) References Cited

FOREIGN PATENT DOCUMENTS

| | | |
|---|---|---|
| JP | 2008-225492 | 9/2008 |
| JP | 2009-015276 | 1/2009 |
| JP | 2009-223289 | 10/2009 |
| JP | 2009-223321 | 10/2009 |
| JP | 2009-223322 | 10/2009 |
| JP | 2009-223323 | 10/2009 |
| JP | 2010-096990 | 4/2010 |
| JP | 2010-243610 | 10/2010 |
| JP | 2011-039207 | 2/2011 |
| JP | 2011-247981 | 12/2011 |
| WO | WO 2010044827 A1 | 4/2010 |

* cited by examiner

DRIVE CIRCUIT, OPTOELECTRONIC DEVICE, ELECTRONIC DEVICE, AND DRIVE METHOD

CROSS-REFERENCE TO RELATED APPLICATIONS

This application is a continuation of pending International Application No. PCT/JP2013/061230, filed on Apr. 15, 2013, entitled "Drive Circuit, Electro-Optic Device, Electronic Device, and Drive Method," the entire contents of which are hereby incorporated by reference. Japanese Patent Application No. 2012-092666, filed Apr. 16, 2012, in the Japanese Patent Office, and entitled: "Drive Circuit, Electro-Optic Device, Electronic Device, and Drive Method," is incorporated by reference herein in its entirety.

BACKGROUND

1. Field

Embodiments described herein relate to a technique for driving an optoelectronic device that uses an emission element emitting light in accordance with a current.

2. Description of the Related Art

For the past several years, there have been developed a display device that utilizes an element (which may be referred to as a light-emitting element or a current light emitting element) emitting light having a brightness corresponding to a supplied current, e.g., an organic electroluminescent (EL) element. The display device controls the amount of current to be supplied to the light-emitting element of each pixel using a driving transistor, thereby making it possible to control a gray scale of a display image. If a characteristic of the driving transistor varies, the characteristic variation may directly appear on the display image.

SUMMARY

One or more embodiments is directed to provide a driving circuit comprising a plurality of pixel circuits arranged in a matrix having columns and pixels, each pixel circuit to supply a light-emitting current according to a data voltage corresponding to a gray scale; a plurality of data lines to supply a data voltage or an initial voltage to each column, n data lines (n being an integer of 2 or more) being disposed each column; a plurality of gate lines to supply scan signals for selecting rows; and a plurality of light-emitting control lines to supply light-emitting control signals indicating whether to supply light-emitting currents of the plurality of pixel circuits. The pixel circuits are divided in to n groups of row, each group being exclusively connected with each of the n data lines in each column, and wherein each of the plurality of pixel circuits comprises a write control transistor to control writing a supplied data voltage in response to a corresponding scan signal; a driving transistor to control the amount of current to be supplied to a light-emitting element in response to a voltage supplied to a gate electrode of the driving transistor; a light-emitting control transistor disposed between the driving transistor and the light-emitting element and to control whether to supply a current to the light-emitting element from a power supply voltage in response to a corresponding light-emitting control signal; a capacitive element disposed between a corresponding data line and the gate electrode of the driving transistor and to retain a voltage corresponding to a write data voltage; and a reset transistor to set the gate electrode of the driving transistor with the initial voltage before a write operation.

In exemplary embodiments, the driving circuit may further include a data line control circuit to control the data voltage; and a light-emitting control signal to control the light-emitting control signals. The data voltage is supplied to one of the n data lines, the data line control circuit supplies the initial voltage to remaining data lines other than the one data line. The light-emitting control circuit performs a control operation such that a light-emitting control transistor of a pixel circuit supplied with the data voltage and a light-emitting control transistor of a pixel circuit set with the initial voltage stops supplying and light-emitting control transistors of remaining pixel circuits other than the pixel circuits supply a current.

In exemplary embodiments, a gate electrode of a write control transistor of a pixel circuit in a first row and a gate electrode of a reset transistor of a pixel circuit in a second row immediately adjacent to the first row may be connected to the same gate line.

In exemplary embodiments, both ends of the capacitive element may be shorted by turning on the reset transistor and the write control transistor.

In exemplary embodiments, both ends of the capacitive element may be shorted by turning on the reset transistor.

In exemplary embodiments, n may be 2, pixel circuits in an odd-numbered row may be connected to a first data line and pixel circuits of an even-numbered row may be connected to a second data line.

One or more embodiments is directed to providing an optoelectronic device including the driving circuit and current light-emitting elements supplied with the light-emitting currents of the plurality of pixel circuits.

One or more embodiments is directed to providing an electronic device including a display unit to use the optoelectronic device and a control unit to control a gray scale of the display unit.

One or more embodiments is directed to providing a method of driving a device that includes a plurality of pixel circuits arranged in a matrix having columns and rows, a plurality of data lines for each column, n data lines (n being an integer of 2 or more) being disposed each column, a plurality of gate lines for selecting rows, and a plurality of light-emitting control lines, the pixel circuits being divided into n groups of rows, each group of rows being exclusively connected with a corresponding data line, the method including supplying a data voltage to one of the n data lines and an initial voltage to remaining data lines other than the one data line, and switching supplying the data voltage to the remaining data lines and supplying the initial voltage to the one data line.

The method may include initializing and writing each pixel circuit independently.

The method may include emitting light from at least one pixel circuit in each group of pixel circuits connected to a data line not supplied with the data voltage.

The method may include writing at least one pixel circuit connected to the data line supplied with the data voltage and turning off remaining pixels in the group including the at least one pixel circuit being written.

Once all pixel circuits have been written, the method may include alternating off and light emitting states between the groups of pixel circuits.

BRIEF DESCRIPTION OF THE DRAWINGS

Features will become apparent to those of ordinary skill in the art by describing in detail exemplary embodiments with reference to the attached drawings in which.

DETAILED DESCRIPTION

Figure 1:
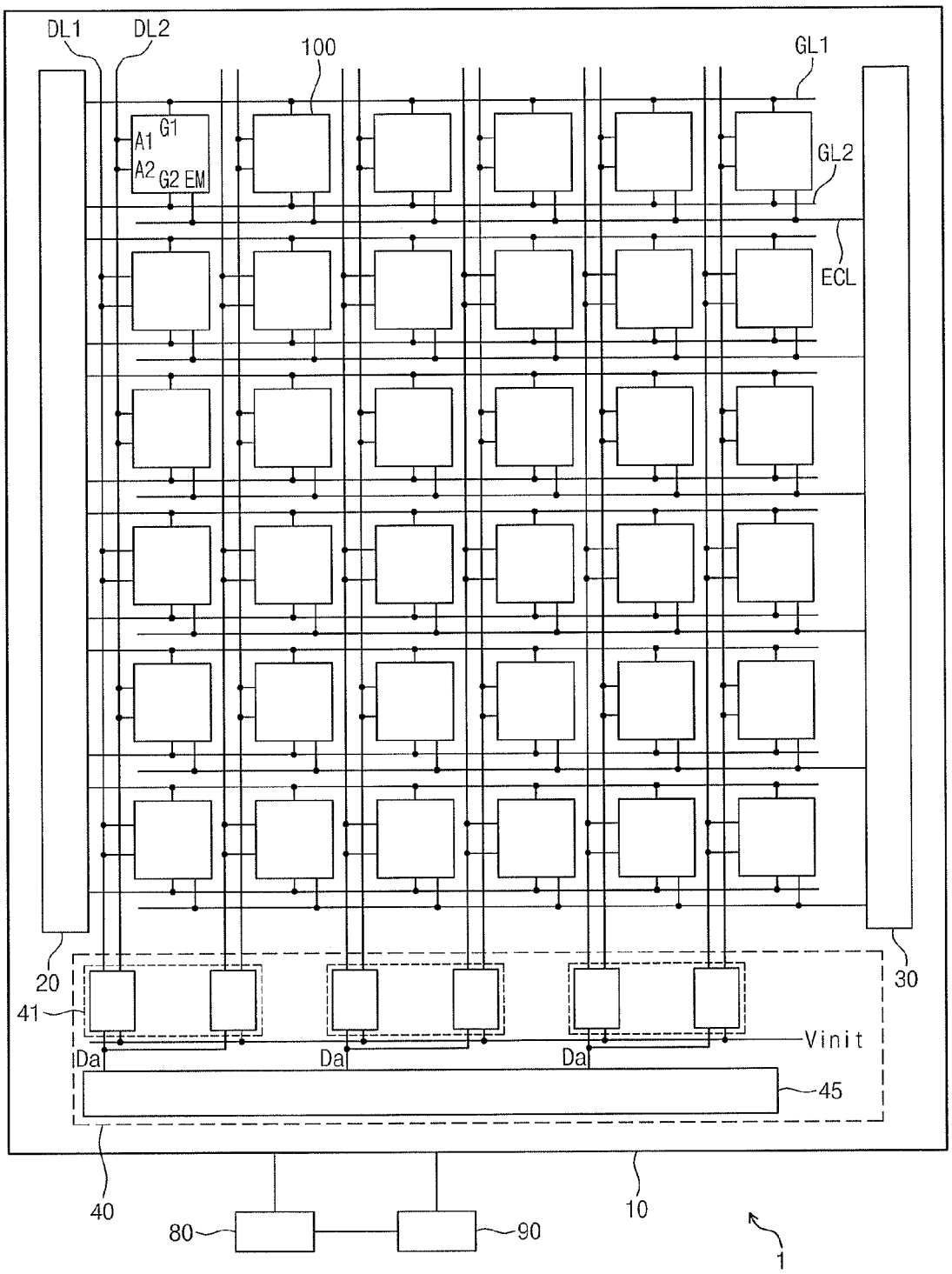
FIG. 1 illustrates a schematic diagram of a configuration of an electronic device according to a first embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

Accordingly, known processes, elements, and techniques are not described with respect to some of the embodiments of. Unless otherwise noted, like reference numerals denote like elements throughout the attached drawings and written description, and thus descriptions will not be repeated. In the drawings, the sizes and relative sizes of layers and regions may be exaggerated for clarity.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings herein.

Spatially relative terms, such as "beneath", "below", "lower", "under", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly The terminology used herein is for the purpose of describing particular embodiments only and is not intended to be limiting of the embodiments. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Also, the term "exemplary" is intended to refer to an example or illustration.

It will be understood that when an element or layer is referred to as being "on", "connected to", "coupled to", or "adjacent to" another element or layer, it can be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

An electronic device according to a first embodiment will be described in detail with reference to accompanying drawings.

FIG. 1 illustrates a schematic diagram of a configuration of an electronic device according to a first embodiment. An electronic device is a device that has a display unit to display an image. Examples of the device may include the following: a smart phone, a handheld telephone, a personal computer, a television, and so forth. The electronic device 1 contains an optoelectronic device 10, a control unit 80, and a power supply unit 90. The optoelectronic device 10 is of pixels 100 arranged in a matrix. The optoelectronic device 10 displays images by making a light-emitting element of each pixel 100 emit light, forming the display unit. Each pixel 100 may have a current light-emitting element 190 and a pixel circuit 110 for driving the current light-emitting element 190 (refer to FIG. 3). An embodiment is exemplified as the light-emitting element 190 is a light-emitting element using organic EL; however, other light-emitting elements may be used in which brightness of emitted light varies with the amount of current supplied.

Also, in FIG. 1, the pixels 100 are arranged in a six-by-six matrix, i.e., six rows by six columns. However, embodiments are not limited thereto. For example, more or less pixels may be arranged. Below, an embodiment will be exemplified as the pixels are arranged in an i-by-j matrix. A detailed description on the optoelectronic device 100 will be made later.

The control unit 80 is a controller that controls an operation of the optoelectronic device 10 and may include components such as, but not limited to, a central processing unit (CPU) and a memory and controls an operation of the optoelectronic device 10. The control unit 80 controls light-emitting of the current light-emitting element 190 by determining a gray scale of each pixel 100 on the basis of image data indicating an image to be displayed on the display unit of the electronic device 1 and writing the pixel circuit 110 with a data voltage corresponding to the determined gray scale.

The power supply unit 90 powers components of the electronic device 1 including the optoelectronic device 10 and the control unit 80. The current light-emitting element 190 of the optoelectronic device 10 is supplied with current from the power supply unit 90 through a power line. Not illustrated in FIG. 1, the power line is between the power supply unit 90 and each pixel 100.

The optoelectronic device 10 includes the pixels 100, a gate line control circuit 20, a light-emitting control circuit 30, and a data line control circuit 40.

The gate line control circuit 20 supplies a scan signal G1 and scan signal G2 to a first gate line GL1 and a second gate line GL2 that correspond to each pixel row (or, a row of pixels). The gate line control circuit 20 performs an initialization operation in response to the scan signals G1 and G2 to select a row of pixels 100 (or, pixel circuits 110) at which data voltages are to be written. Sequential and exclusive selection may be made in order of first row, second row, . . . i-th row.

The light-emitting control circuit 30 supplies a light-emitting control signal EM to a light-emitting control line ECL corresponding to each row of pixels 100. The light-emitting control circuit 30 determines whether to supply current to the current light-emitting elements 190 of pixels in each row, based on the light-emitting control signal EM.

The data line control circuit 40 supplies either a data voltage Da or an initial voltage Vinit to first and second data lines DL1 and DL2. The initial voltage Vinit is a voltage belonging to a voltage range (from a maximum voltage to a minimum voltage) that the data voltage Da can have. In exemplary embodiments, the initial voltage Vinit may be a voltage of (Vmax−Vmin)/2 (Vmax being a maximum voltage and Vmin being a minimum voltage).

The first and second data lines DL1 and DL2 may be disposed to correspond to each column of pixels 100. In exemplary embodiments, the first data line DL1 is connected to pixels 100 (or pixel circuits 110) in an even-numbered row, and the second data line DL2 is connected to pixels 100 (or pixel circuits 110) in an odd-numbered row.

The data line control circuit 40 contains a plurality of demultiplexers (DeMUX) 41 and a shift register 45 for supplying data voltages to the demultiplexers 41, respectively. The shift register 45 converts a serial data voltage signal provided from the control unit 80 into parallel data voltage signals and outputs the parallel data voltage signals to the demultiplexers 41, respectively. In response to a control signal from the control unit 80, each demultiplexer 41 supplies a data voltage Da from the shift register 45 to one of the first data line DL1 and the second data line DL2 and the initial voltage Vinit to the other thereof.

Figure 2:
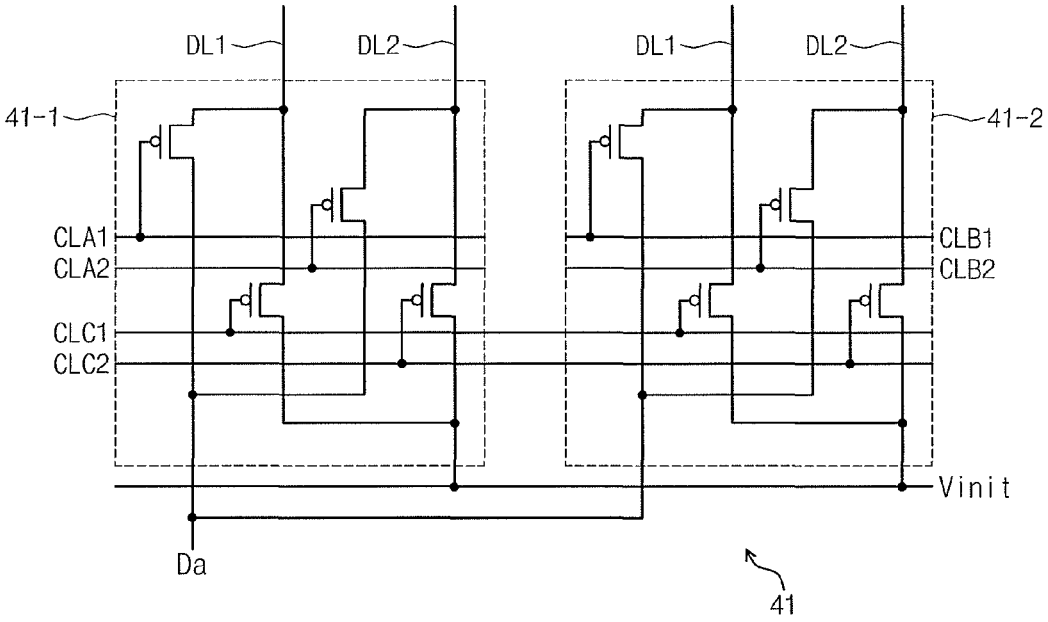
FIG. 2 illustrates a circuit diagram schematically of a configuration of a demultiplexer according to a first embodiment.

FIG. 2 illustrates a circuit diagram schematically showing a configuration of a demultiplexer 41 according to a first embodiment. A demultiplexer 41 includes a first block 41-1 and a second block 41-2 and operates in response to control signals CLA1, CLA2, CLB1, CLB2, CLC1, and CLC2 that are supplied according to a control of the control unit 80. Each of the first block 41-1 and the second block 41-2 may be configured as illustrated in FIG. 2, using p-type thin film transistors (Tufts). Below, a transistor may be a p-type TFT if not specified.

Figure 4:
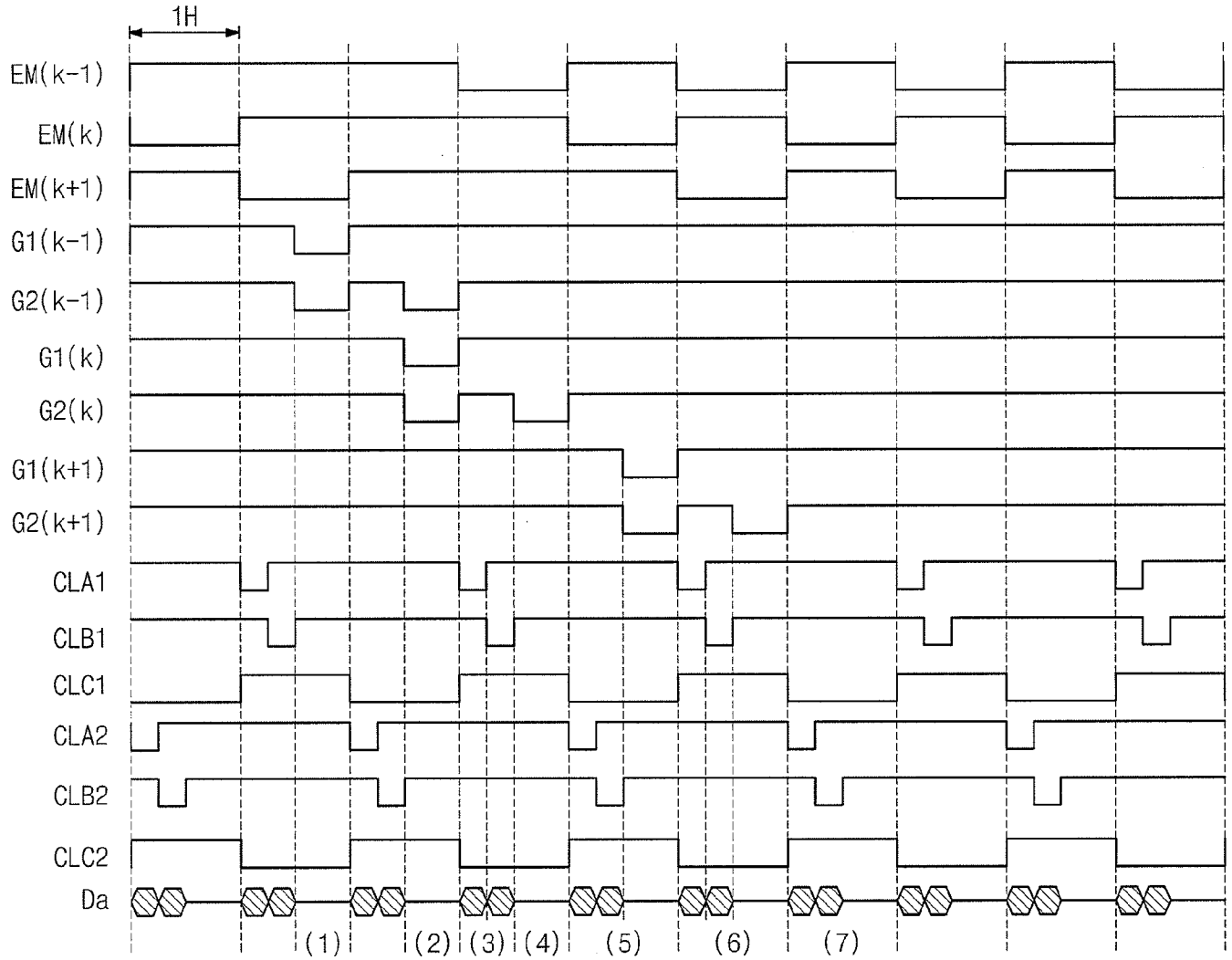
FIG. 4 illustrates a timing diagram showing signals associated with a pixel circuit 110 in a k-th row, according to a first embodiment.

The control signals CLA1, CLA2, CLB1, CLB2, CLC1, and CLC2, illustrated in FIG. 4, are supplied to the demultiplexer 41. A voltage used in the first block 41-1 and a voltage used in the second block 41-2 are alternately received as a data voltage Da provided from a shift register 45.

Thus, the first block 41-1 maintains the initial voltage Vinit of a second data line DL2 when retaining a first data line DL1 with the data voltage Da. Also, the first block 41-1 maintains the initial voltage Vinit of the first data line DL2 when retaining the second data line DL2 with the data voltage Da. The second block 41-2 operates in the same way as the first block 41-1. However, an operating timing of the first block 41-1 gets out as illustrated in FIG. 4, but it corresponds to a timing of a data voltage Da output from the shift register 45.

Figure 3:
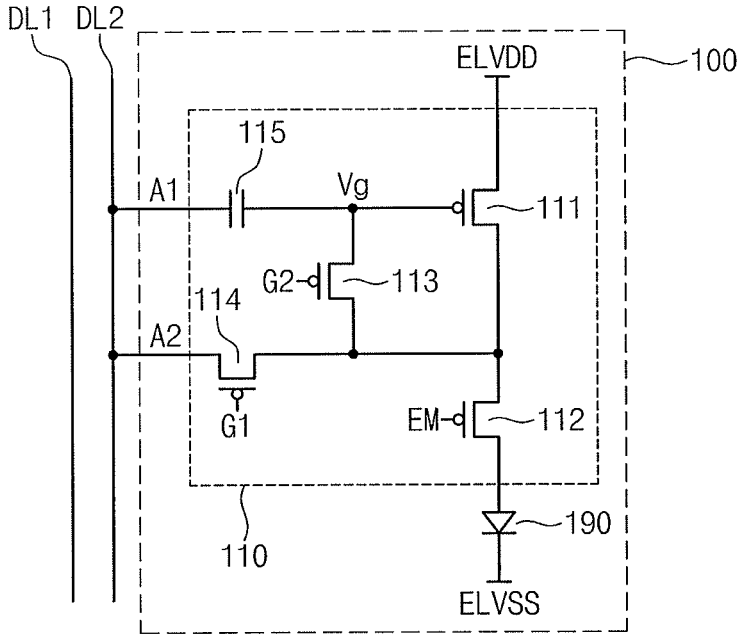
FIG. 3 illustrates a circuit diagram of a configuration of a pixel according to a first embodiment.

FIG. 3 illustrates a circuit diagram of a configuration of a pixel 100 according to a first embodiment. A pixel 100 contains a pixel circuit 110 and a current light-emitting element 190 as described above. The pixel circuit 100 includes transistors 111, 112, 113, and 114, and a capacitive element 115. A source terminal of the transistor 111 is connected to a high power voltage ELVDD from which current is supplied to the current light-emitting element 190. A drain terminal of the transistor 111 is connected to a source terminal of the transistor 112. The transistor 111 is a transistor that controls the amount of current flowing between its source and drain according to a gate voltage Vg applied to its gate electrode and controls the strength of light-emitting of the current light-emitting element 190. Also, the gate voltage Vg varies with a data voltage Da written at the pixel circuit 110.

The current light-emitting element 190 is connected to a drain terminal of the transistor 112 and a low power voltage ELVSS. A gate electrode of the transistor 112 is connected to a light-emitting control line ECL.

The transistor 112 is turned off or on in response to a light-emitting control circuit EM from the light-emitting control line ECL. When turned off, the transistor 112 stops supplying current to the current light-emitting element 190, thereby terminating light-emitting of the current light-emitting element 190. When turned on, the transistor 112 supplies current to the current light-emitting element 190. At this time, current, an amount of which is controlled by the transistor 112, flows into the current light-emitting element 190, thereby making it possible for the current light-emitting element 190 to emit light. Accordingly, the transistor 112 acts as a light-emitting control transistor.

One of source and drain terminals of the transistor 113 is connected to the gate electrode of the transistor 111, and the other thereof is connected to the drain terminal of the transistor 111 (or, a source terminal of the transistor 112).

The transistor 113 has a gate electrode connected to a second gate line GL2. Turn-on or turn-off states of the transistor 113 are controlled by a scan signal G2 from the second gate line GL2. The transistor 113 is a write control transistor that controls an operation of writing a data voltage Da at a pixel circuit 110.

One of source and drain terminals of the transistor 114 is connected to the second data line DL2 (A2 in FIG. 3), and the other thereof is connected to the drain terminal of the transistor 111 (to both the source terminal of the transistor 112 and the source/drain terminal of the transistor 113 which is connected to the drain terminal of the transistor 111 and the source terminal of the transistor 112). Turn-on and turn-off states of the transistor 114 are controlled by the scan signal G1 from the first gate line GL1. The transistor 114 serves as a reset transistor (for initialization operation) that sets a gate voltage Vg of the transistor 111 with an initial voltage Vinit. In exemplary embodiments, when the initial voltage Vinit is supplied to the second data line DL2, both transistors 113 and 114 are turned such that both ends of the capacitive element 115 are shorted.

A first end of the capacitive element 115 is connected to the second data line DL2 (A1 in FIG. 3) and a second end thereof is connected to the gate electrode of the transistor 111 (to the source/drain terminal of the transistor 113 connected to the gate terminal of the transistor 111). As will be described later, the capacitive element 115 holds a voltage corresponding to a data voltage to be written at the pixel circuit 110.

The pixel 100 shown in FIG. 3 is a pixel in an odd-numbered row. For a pixel 100 in an even-numbered row, the transistor 114 and the capacitive element 115 are connected to a first data line DL1, not the second data line DL2. The above is a description on a configuration of the optoelectronic device 10.

Figure 5:
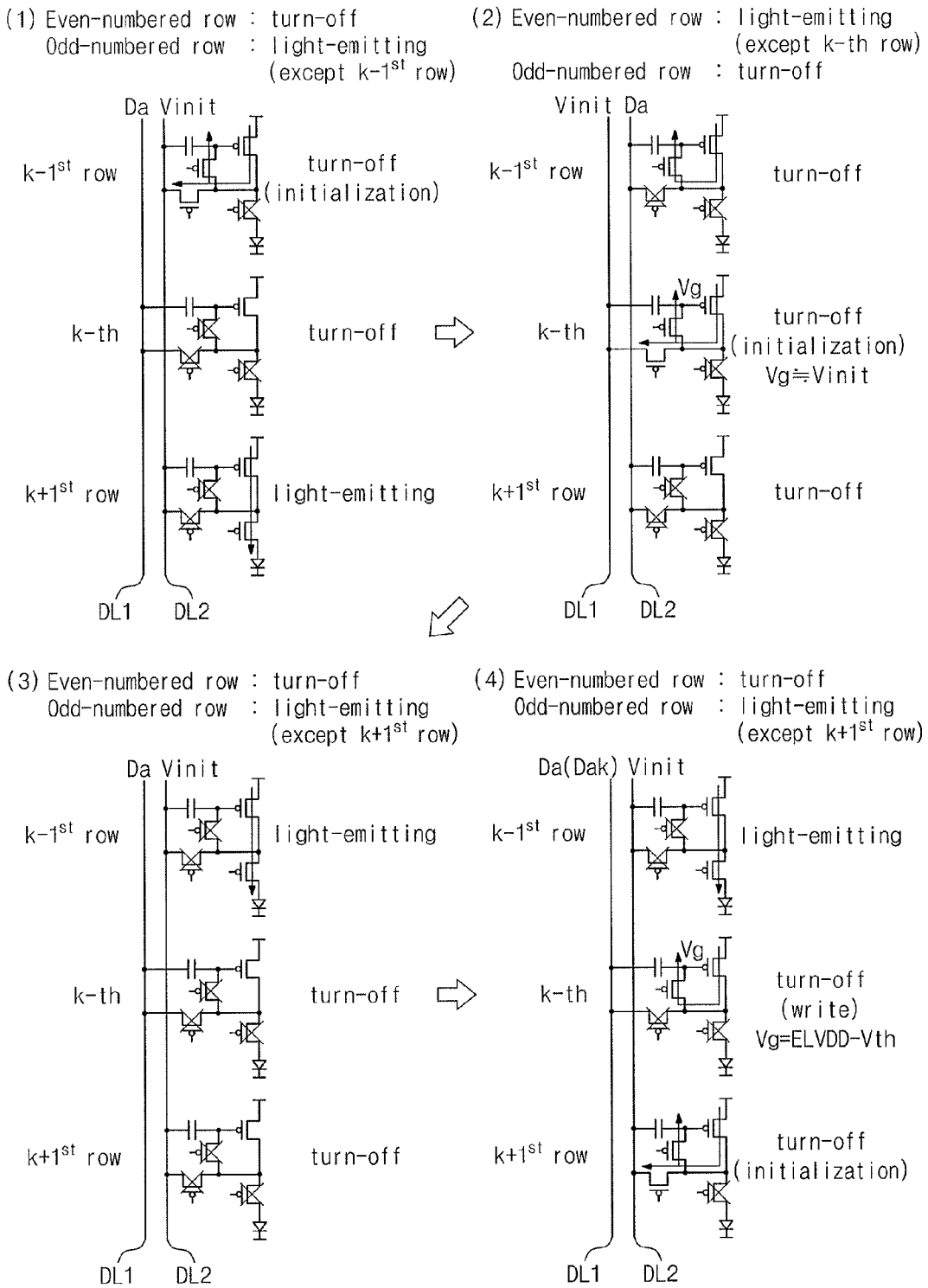
FIGS. 5 and 6 illustrate diagrams for describing states of pixel circuits in a k-th row and preceding and following rows (k−1st row and k+1st row) in each period (k being an even number), according to a first embodiment.
Figure 6:
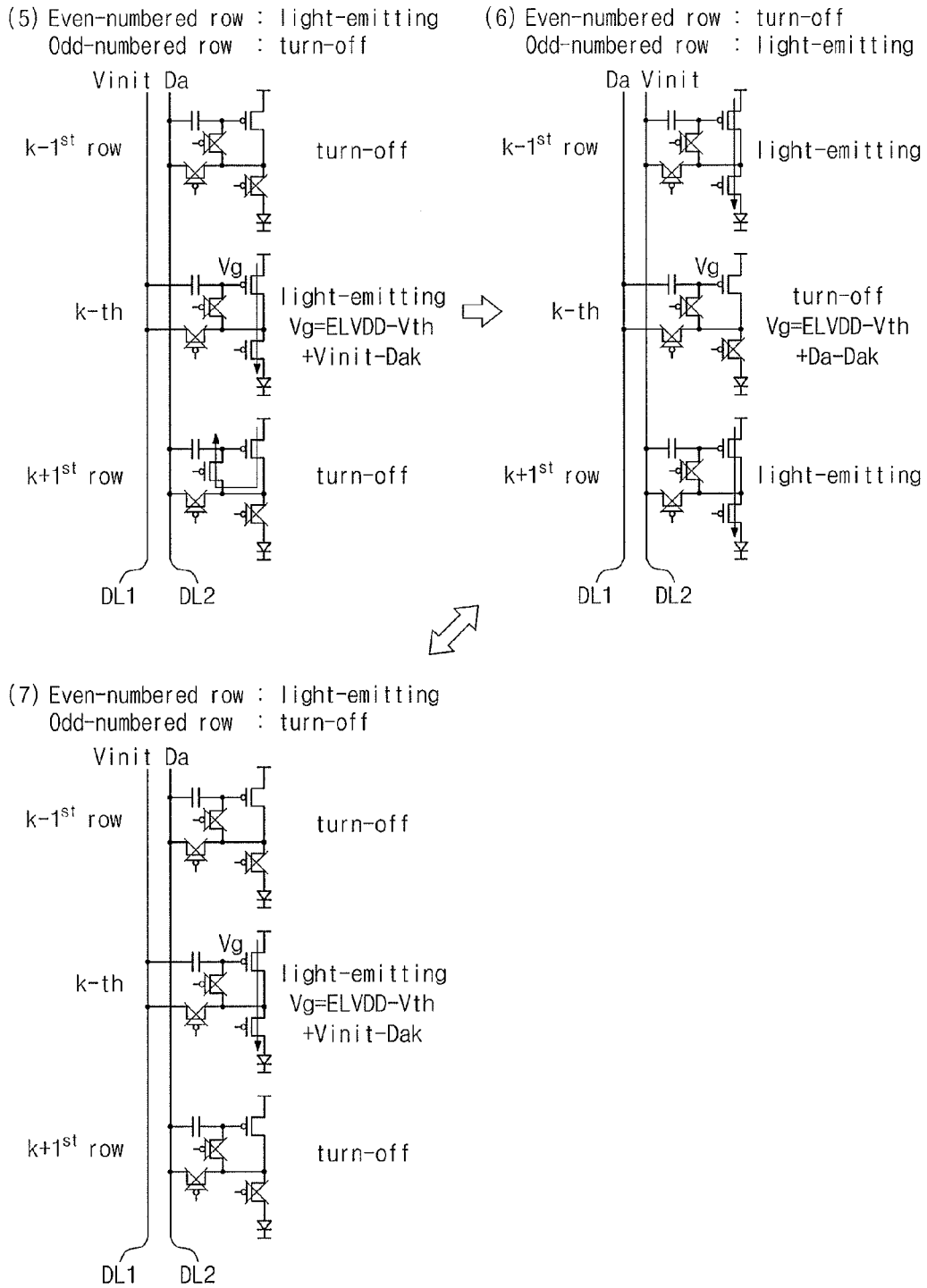

FIG. 4 is a timing diagram showing signals associated with a pixel circuit 110 in a k-th row. FIGS. 5 and 6 are diagrams for describing states of pixel circuits 110 in a k-th row and preceding and following rows ($k-1^{St}$ row and $k+1^{st}$ row) in each period (k being an even number). In FIG. 4, symbols ($k+1^{st}$), (k), and (k−1) indicates signals supplied to a $k+1^{st}$ row, a k-th row, and a $k-1^{St}$ row. For example, (EM)(k) indicates a light-emitting control signal to be supplied to a k-th row.

In FIG. 4, "1 H" indicates 1 horizontal scan period. In 1H, a data voltage Da is received twice. A first received data voltage Da is a voltage to be supplied to a first data line DL1, while a second received data voltage Da is a voltage to be provided to a second data line DL2. In FIG. 4, (1) through (7) correspond to periods shown in FIGS. 5 and 6. The remaining signals other than a data voltage signal have high-level or low-level voltages. In exemplary embodiments, since a transistor is p-type, it is turned on when a low-level voltage is applied to a gate electrode of the transistor.

Referring to (1) of FIG. 5, since a data voltage Da is supplied to a first data line DL1, a gate voltage Vg of the transistor 111 of the pixel circuit 110 in an even-numbered row connected to the first data line DL1 varies with a level of the data voltage Da due to influence of the capacitive coupling of a capacitive element 115. Therefore, the pixel circuit 110 in the even-numbered row is controlled such that the current light-emitting element 190 is turned off, i.e., EM(k) is high, to prevent the gate voltage Vg, which is different from a voltage corresponding to a gray scale to be expressed from being displayed.

In (1), an initial voltage Vinit is supplied to the second data line DL2, such that, for a pixel circuit 110 in an odd-numbered row, i.e., $k+1^{St}$ row, a gate voltage Vg of the transistor 111 of the pixel circuit 110 in the odd-numbered row connected to a second data line DL2 becomes a voltage corresponding to a gray scale to be expressed (this will be described with reference to (5) of FIG. 6). In the pixel circuit 110 in the odd-numbered row, thus, a current light-emitting element 190 is controlled to emit light, i.e., EM(k+1) is low and G1(k+1) and G2(k+1) are high. However, the pixel circuit 110 in a $k-1^{St}$ row, although being an odd-number row, is controlled to turn off the current light-emitting element 190 and the gate voltage Vg is reset to the initial voltage Vinit, i.e., EM(k−1) is high and G1(k+1) and G2(k+1) are low.

Next, referring to (2) of FIG. 5, the data voltage Da is supplied to the second data line DL2 and the initial voltage Vinit to the first data line DL1. Thus, the current light-emitting element 190 of the pixel circuit 110 in the odd-numbered row is controlled to be turned off, while the current light-emitting element 190 of the pixel circuit 110 in the even-numbered row is controlled to be turned on, except in the k-th row, in which G1(k) and G2(k) are low and EM(k) are high, such that the gate voltage is reset to the initial voltage Vinit, since the gate voltage Vg becomes higher than the initial voltage Vinit due to influence of a high power voltage ELVDD in the k-th row. In the $k-1^{St}$ row, G1(k−1) is high, turning off the transistor 114, while G2(k−1) remains low, leaving on the transistor 113. In both the $k-1^{St}$ and $k+1^{st}$ rows, EM(k−1) and EM(k+1) are high.

Referring to (3) of FIG. 5, the initial voltage Vinit is now supplied to the second data line DL2, while the data voltage Da is supplied to the first data line DL1. At this time, the current light-emitting element 190 of the pixel circuit 110 in the odd-numbered $k-1^{St}$ row is controlled to emit light, i.e., EM(k−1) is low, while G2(k−1) is high. The current light-emitting element 190 of the pixel circuit 110 in the even-numbered row is controlled to be turned off, i.e., EM(k), G1(k), and G2(k) are all high. However, the current light-emitting element 190 of the pixel circuit 110 in a $k+1^{St}$ row is controlled to be turned off because an initialization operation is performed in the last half of 1H, i.e., EM(k+1), G1(k+1), and G2(k+1) are all high.

In exemplary embodiments, the transistor 113 of the pixel circuit 110 in a k-th row goes to a turn-off state in a period of (3) such that a time needed to compensate for a variation in a threshold voltage of a transistor 111 is not different from that of a pixel circuit 110 in another column during continuous writing of data voltages.

In (4) of FIG. 5, a voltage corresponding to the data voltage Da is written at the pixel circuit 110 by turning on the transistor 113 (G2(k) is low) of the pixel circuit 110 in the k-th row corresponding to a write target from (3) of FIG. 5. Thus, the gate voltage Vg becomes (ELVDD−Vth) (Vth being a threshold voltage of the transistor 111), and the capacitive element 115 retains a voltage corresponding to the data voltage (Da) (hereinafter, referred to as a write voltage Dak). In (4), the odd numbered rows, other than the $k+1^{st}$ row, continue to emit light. G1(k+1) and G2(k+2) are now low to initialize the pixel circuit 190 in the $k+1^{st}$ row.

Referring to (5) of FIG. 6, the data voltage Da (Dak) supplied to the first data line DL1 is changed into the initial voltage Vinit, and a voltage difference (Vinit−Dak) varies the gate voltage Vg of the pixel circuit 110 in the k-th row (even-numbered row) due to the capacitive coupling of the capacitive element 115. The gate voltage Vg thus varied may be (ELVDD−Vth+Vinit−Dak). Accordingly, the gate voltage Vg is of a voltage corresponding to a gray scale, and the current light-emitting element 190 in the even-numbered row emits light with the strength corresponding to the gray scale.

In (5), the current light-emitting element 190 of the pixel circuit 110 in an odd-numbered row is controlled to be turned off; while, the current light-emitting element 190 of the pixel circuit 110 in an even-numbered row is controlled to emit light. As described above, the current light-emitting element 190 of the pixel circuit 110 to be initialized is controlled to be turned off although being an even-numbered row. Also, the data voltage Da is written at the pixel circuit 110 in the k+1$^{st}$ row.

Referring to (6) of FIG. 6, the data voltage Da is supplied to the first data line DL1, and the initial voltage Vinit is supplied to the second data line DL2. At this time, the gate voltage Vg of the pixel circuit 110 in the k-th row is changed into (ELVDD−Vth+Da−Dak) and is different from a value set as a voltage corresponding to a gray scale. Also, since the data voltage Da is a voltage to be written at the pixel circuit 110 of another row, its value may variously vary with a gray scale of the pixel 100.

Therefore, the current light-emitting element 190 of the pixel circuit in the even-numbered row is controlled to be turned off; on the other hand, the current light-emitting element 190 of the pixel circuit in the odd-numbered row is controlled to emit light.

In comparison with (6) of FIG. 6, in (7) of FIG. 6, the initial voltage Vinit is supplied to the first data line DL1, and the data voltage Da is supplied to the second data line DL2. Therefore, the current light-emitting element 190 of the pixel circuit in the odd-numbered row is controlled to be turned off, and the current light-emitting element 190 of the pixel circuit in the even-numbered row is controlled to emit light. Afterwards, states of (6) and (7) of FIG. 6 are iterated until a next data voltage is written.

In an optoelectronic device 10 according to a first embodiment, a current light-emitting element 190 of a pixel circuit 110, which is connected to a data line different from a data line to which a data voltage Da is being supplied, emits light while the data voltage Da is written at a pixel circuit 110 in any row. Thus, it is possible to make it possible to increase time available to write the data voltage Da at each pixel circuit 110, and to improve of the quality of display and high-definition implementation are possible. Also, it is possible to make a threshold voltage compensation time long, thereby reducing unevenness of images.

An optoelectronic device 10 according to a second embodiment is configured such that first and second data lines DL1 and DL2 according to a first embodiment of are used in common. The optoelectronic device 10A according to the second embodiment will be described. Also, in the second embodiment, components that are identical to those according to the first embodiment are marked by the same reference numerals, and a description thereof is thus omitted.

Figure 7:
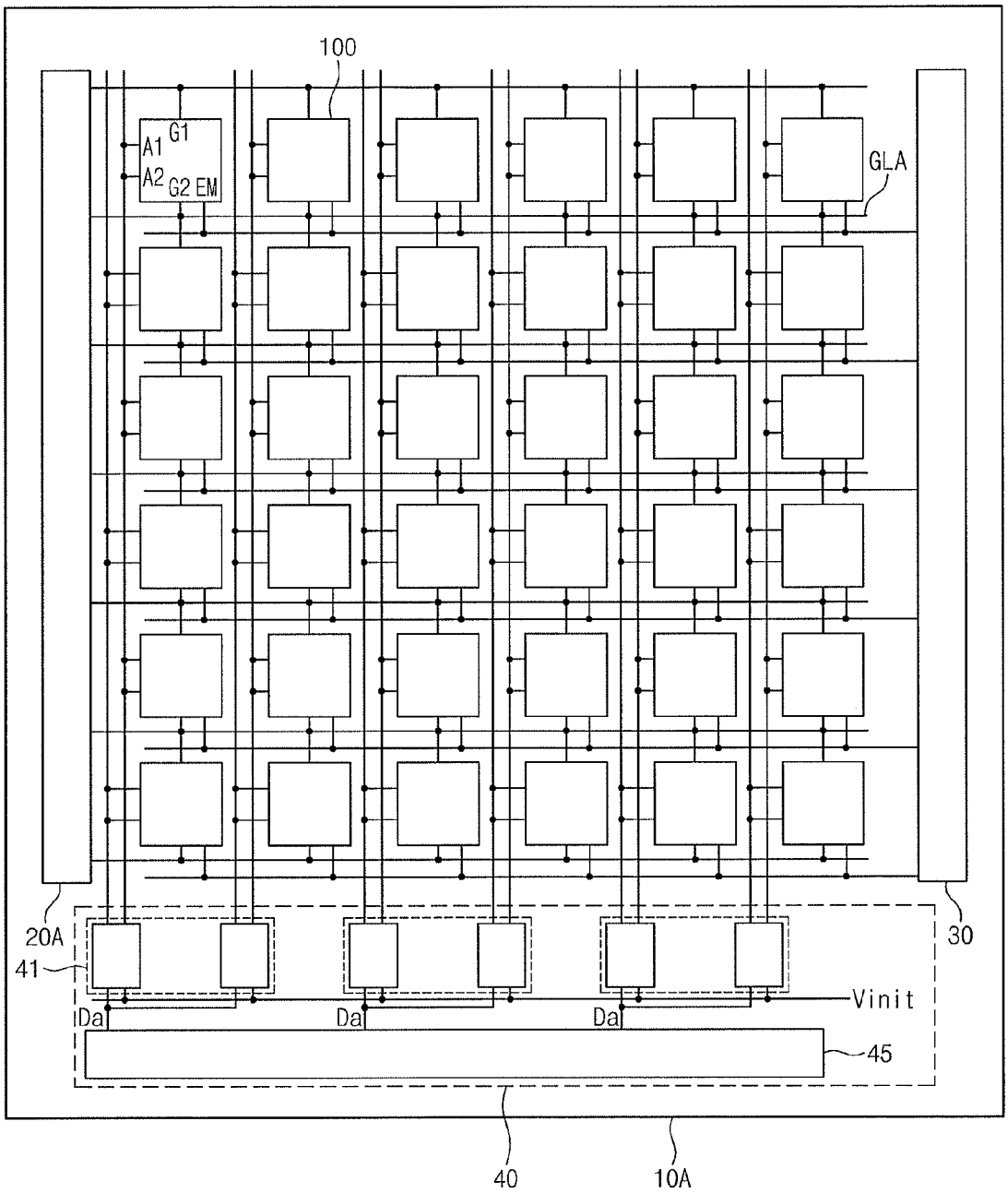
FIG. 7 illustrates a schematic diagram of a configuration of an optoelectronic device according to a second embodiment.

FIG. 7 illustrates a schematic diagram of a configuration of an optoelectronic device 10A according to a second embodiment. An optoelectronic device 10A according to a second embodiment has a gate line GLA that is implemented by merging first and second data lines DL1 and DL2 of the first embodiment. Thus, the gate line GLA connected with a gate electrode of the transistor 114 of the pixel circuit 110 in a k-th row is connected to the gate electrode of the transistor 113. In this case, a gate line control circuit 20A provides the gate line GLA with a scan signal G12, obtained by merging scan signals G1 and G2 according to the first embodiment, to control a pixel circuit 110.

Figure 8:
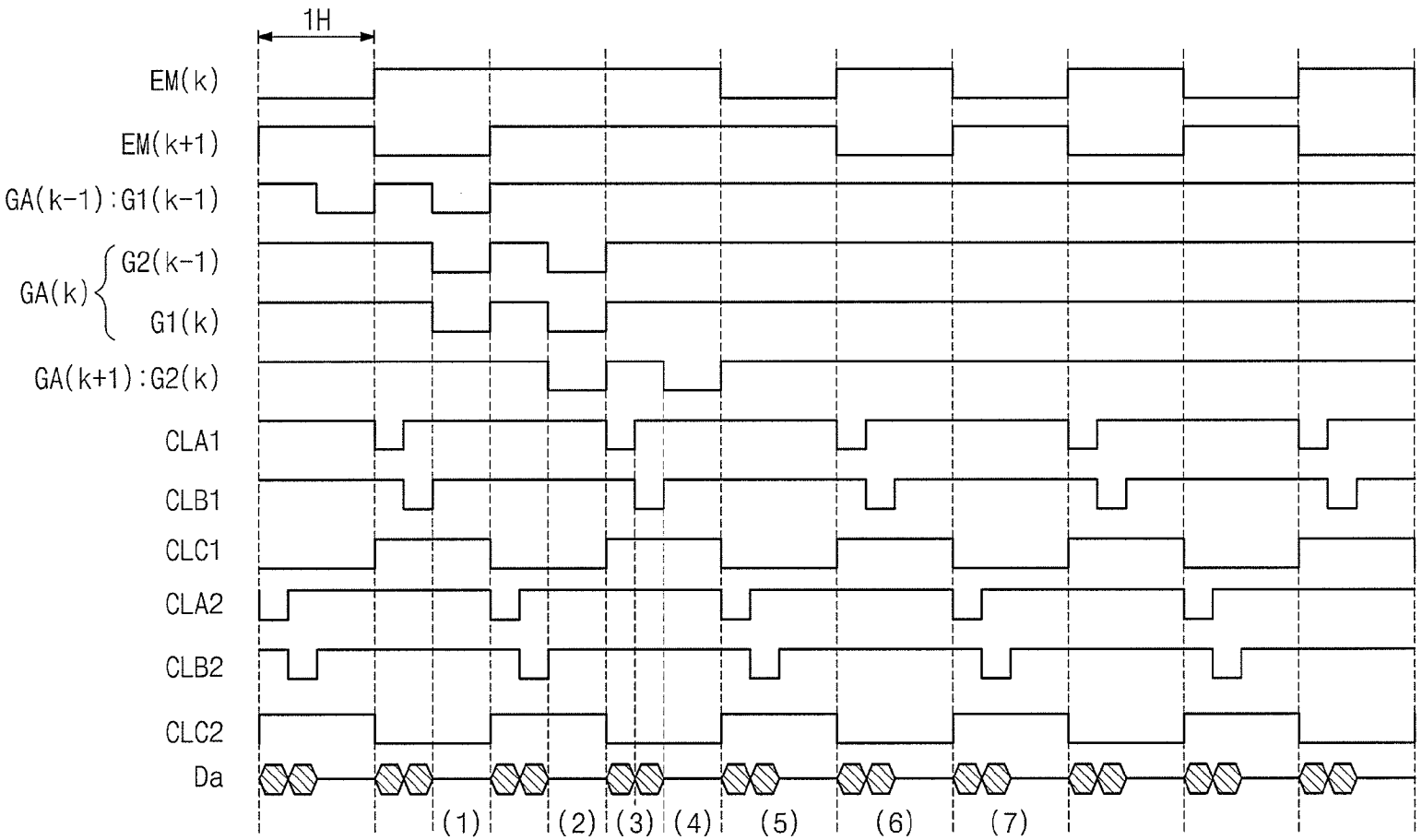
FIG. 8 illustrates a timing diagram showing signals associated with a pixel circuit in a k-th row, according to a second embodiment.

FIG. 8 is a timing diagram showing signals associated with a pixel circuit 110 in a k-th row, according to a second embodiment. FIG. 8 shows GA(k) obtained by making G1(k) and G2(k−1) of a first embodiment identical. In FIG. 8, signals G1(k) and G2(k−1) have the same waveform. Thus, a period (1) according to a second embodiment is different from that according to the first embodiment.

Figure 9:
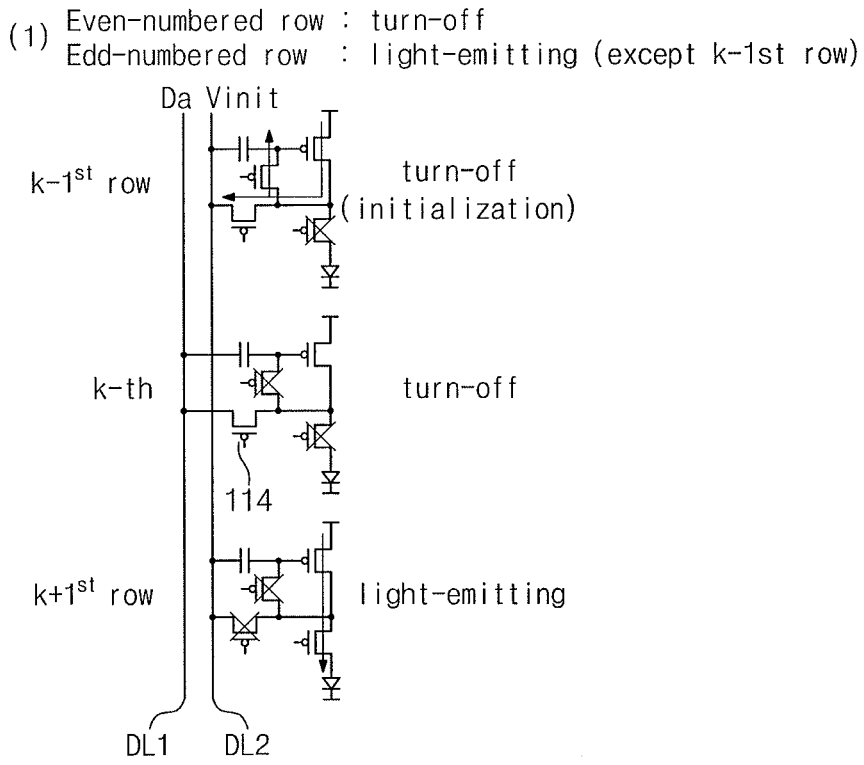
FIG. 9 illustrates a diagram for describing states of pixel circuits 110 in a k-th row and preceding and following rows (k−1 st row and k+1st row) in each period (1), according to a second embodiment.

FIG. 9 is a diagram for describing states of pixel circuits 110 in a k-th row and preceding and following rows (k−1$^{St}$ row and k+1$^{st}$ row) in each period ( 1). In a period of (1), a transistor 114 of a pixel circuit 110 in a k-th row is turned off in a first embodiment, but is turned on in a second embodiment.

Accordingly, current flows from ELVDD to a first data line DL1. This is not problematic in consideration of capacitance of the first data line DL1 because a data voltage Da is not greatly influenced. Also, the pixel circuit 110 in the k-th row does not influence light-emitting of the pixel circuit 110 in the k-th row because the pixel circuit 110 in the k-th row performs an initialization operation in a next period. The number of gate lines in each row is reduced, thereby simplifying a configuration of a gate line control circuit and making high-definition implementation possible.

In first and second embodiments, two data lines (e.g., a first data line DL1 and a second data line DL2) are provided to each column of pixel circuits 110. However, embodiments are not limited thereto. For example, n data lines may be provided to each column of pixel circuits 110. An optoelectronic device 10B according to a third embodiment will be described which includes three data lines provided to correspond to each column of pixel circuits 110 in a configuration of the second embodiment. Also, in the third embodiment, components that are identical to those according to the first and second embodiments are marked by the same reference numerals, and a description thereof is thus omitted.

Figure 10:
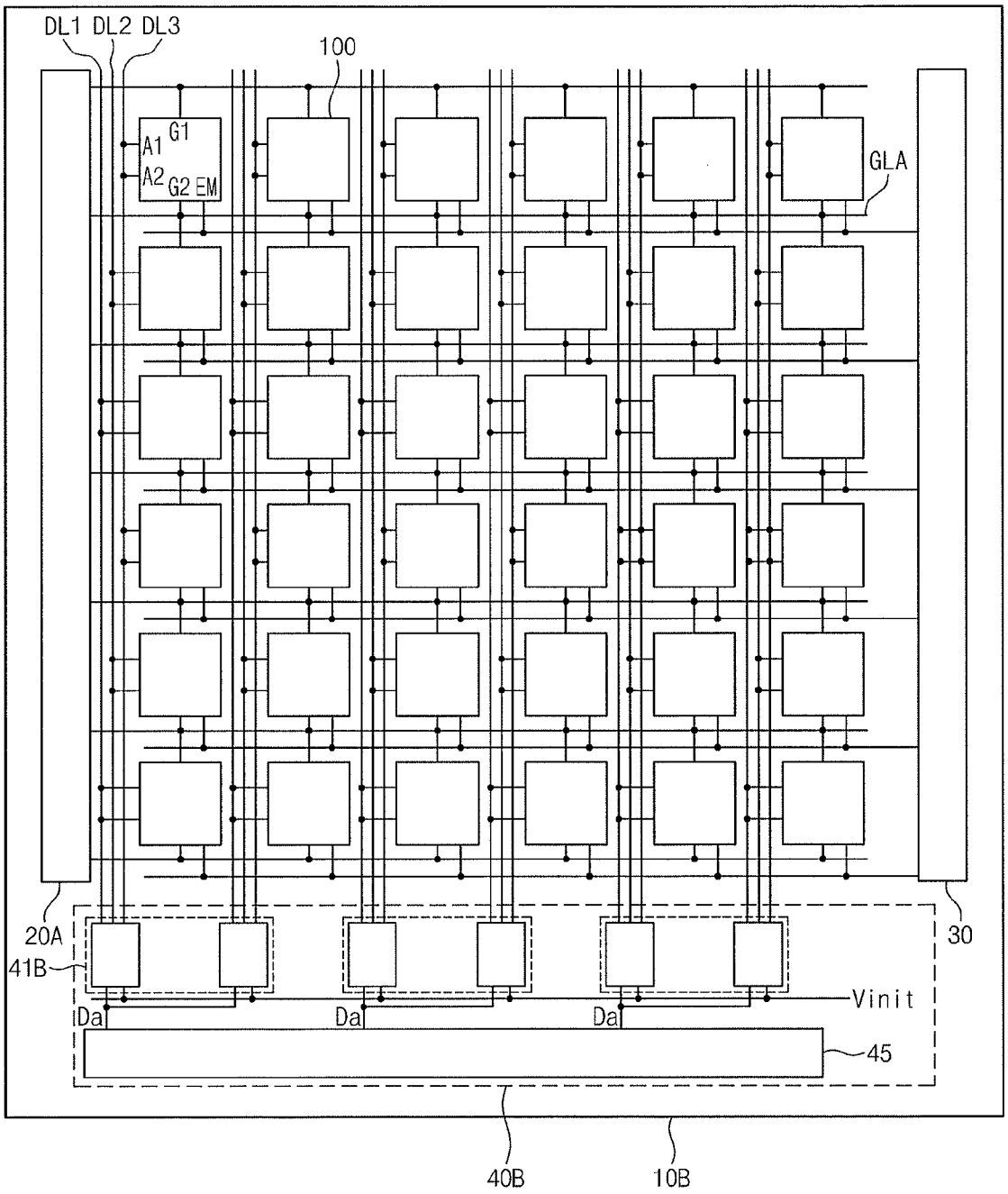
FIG. 10 illustrates a schematic diagram of a configuration of an optoelectronic device according to a third embodiment.

FIG. 10 illustrates a schematic diagram of a configuration of an optoelectronic device 10B according to a third embodiment. As illustrated in FIG. 10, three data lines (a first data line DL1, a second data line DL2, and a third data line DL3) are provided to correspond to each column of pixel circuits 110. A demultiplexer 41B of a data line control circuit 40B provides a data voltage Da from a shift register 45 to one of the first data line DL1, the second data line DL2, and the third data line DL3 and supplies an initial voltage Vinit to the rest.

Figure 11:
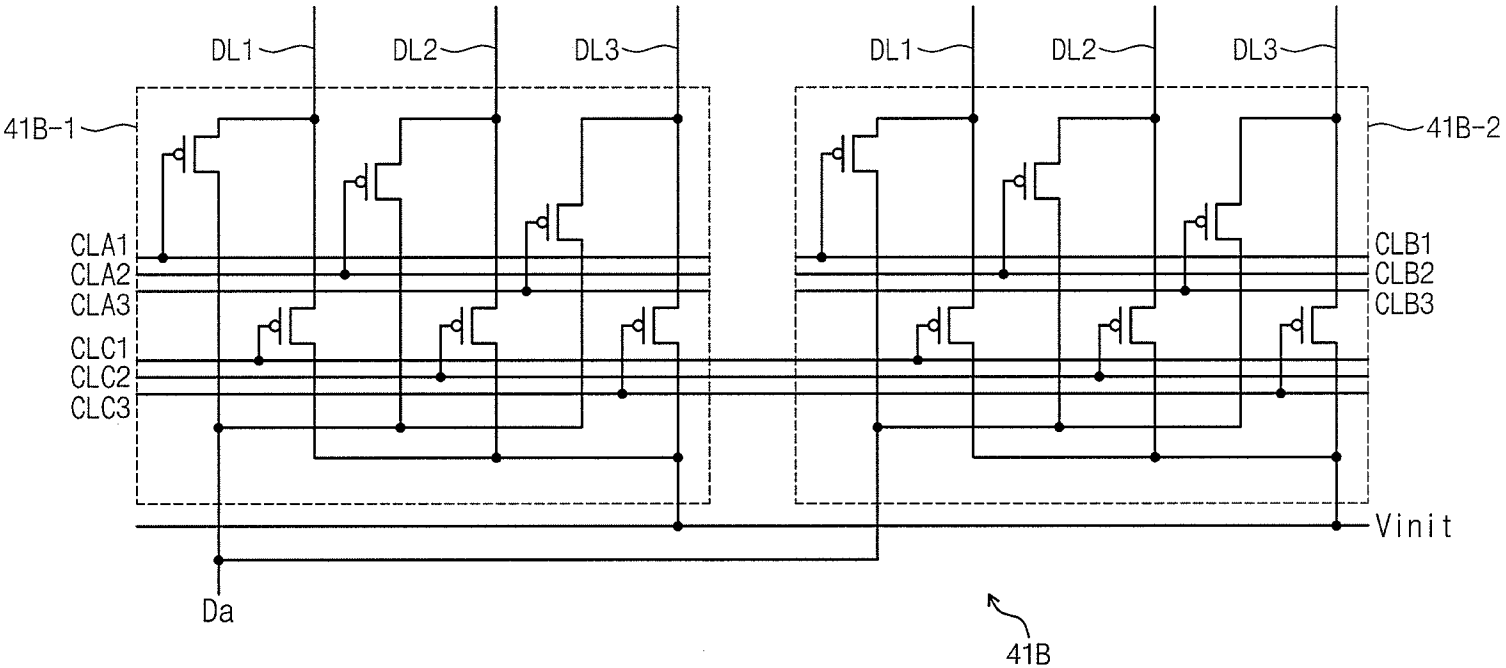
FIG. 11 illustrates a circuit diagram schematically of a configuration of a demultiplexer according to a third embodiment.

FIG. 11 is a circuit diagram schematically illustrating a configuration of a demultiplexer 41B according to a third embodiment. Referring to FIG. 11, a demultiplexer 41B has a first block 41B-1 and a second block 41B-2 and operates in response to control signals CLA1, CLA2, CLA3, CLB1, CLB2, CLB3, CLC1, CLC2, and CLC3 supplied according to a control of a control unit 80.

Figure 13:
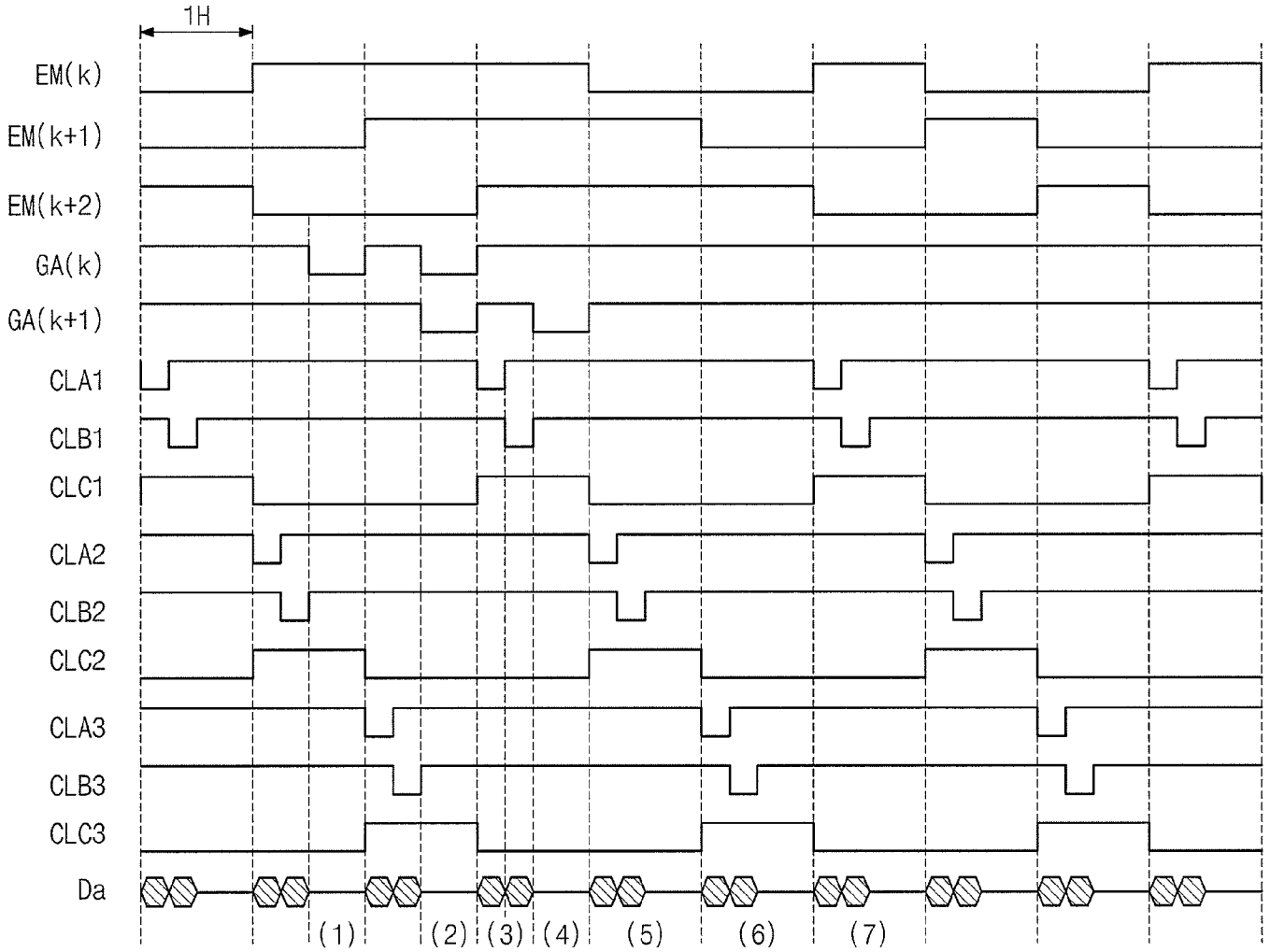
FIG. 13 illustrates a timing diagram showing signals associated with pixel circuits in a k-th row, according to a third embodiment.

The demultiplexer 41B is supplied with the control signals CLA1, CLA2, CLA3, CLB1, CLB2, CLB3, CLC1, CLC2, and CLC3 with a timing shown in FIG. 13.

The first block 41B-1 maintains second and third data lines DL2 and DL3 with an initial voltage Vinit when retaining a first data line DL1 with a data voltage Da, for example.

Figure 12:
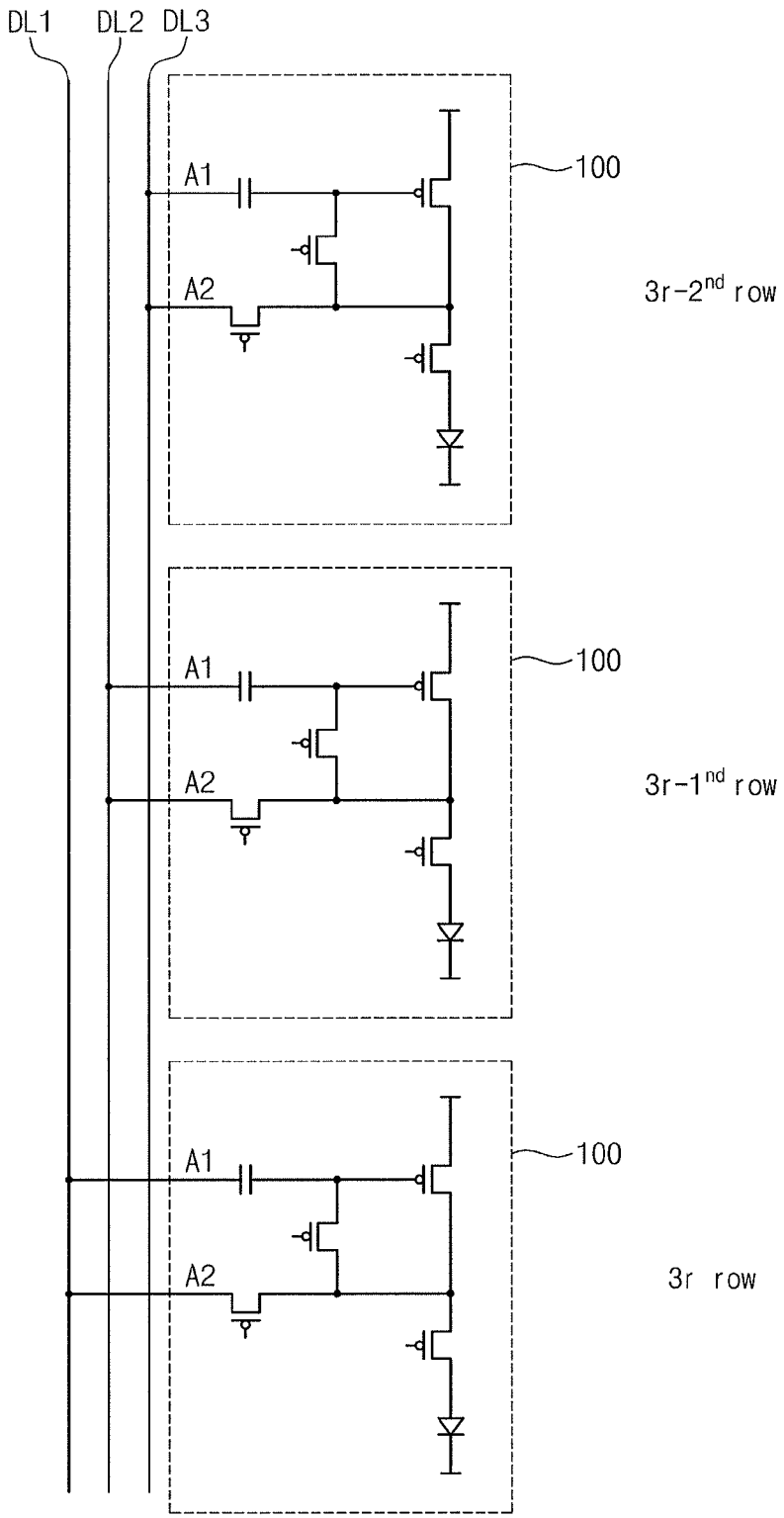
FIG. 12 illustrates a circuit diagram showing an interconnection between pixels and data lines, according to a third embodiment.

FIG. 12 is a circuit diagram showing an interconnection between pixels 100 and data lines, according to a third embodiment. As illustrated in FIG. 12, among pixels 100 in each column of an optoelectronic device 10B, a pixel 100 in a 3r-th row is connected to a first data line DL1, a pixel 100 in a 3r-1$^{st}$ row to a second data line DL2, and a pixel 100 in a 3r-2$^{nd}$ row to a third data line DL3 (r being a natural number).

FIG. 13 is a timing diagram showing signals associated with pixel circuits 100 in a k-th row, according to a third embodiment. In first and second embodiments, light-emitting and turn-off of each pixel 100 are iterated every 1H (1 horizontal scan period) except for a write period. That is, light-emitting is made in 1H of 2H. Meanwhile, light-emitting may be made in 2H of 3H.

As compared with the first and second embodiments, an optoelectronic device 10B according to a third embodiment enables a light-emitting time of a current light-emitting element 190 of each pixel 100 to become longer, thereby reducing the amount of current flowing to the current light-emitting element 190 and obtaining the same luminance with respect to the whole screen with a time average.

When a current light-emitting element 190 is an element to which organic EL is applied, deterioration of the element is accelerated if the light-emitting time is not elongated as long as two times, but current is increased to obtain double the strength of light-emitting. With the optoelectronic device 10B according to the third, deterioration of the current light-emitting element 190 is restrained by increasing the number of data lines corresponding to each column of pixels 100.

Below, a pixel structure according to a fourth embodiment will be described with reference to FIG. 14.

Figure 14:
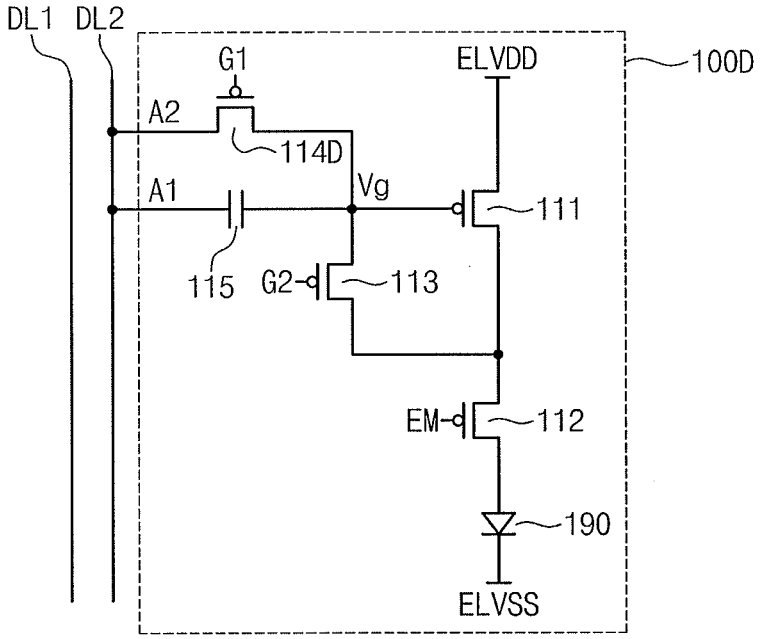
FIG. 14 illustrates a circuit diagram schematically of a configuration of a pixel according to a fourth embodiment.

FIG. 14 is a circuit diagram schematically illustrating a configuration of a pixel 100D according to a fourth embodiment. A pixel 100D according to a fourth embodiment is different from that according to a first embodiment of FIG. 3 in that an interconnection among components of the pixel 100D is changed.

The pixel 100D according to the fourth embodiment is configured the same as that according to the first embodiment except for the interconnection, and a description thereof is thus omitted.

In the pixel 100D, one of source and drain terminals of a transistor 114D is connected to a second data line DL2 (A2 in FIG. 14), and the other thereof is connected to one end of a capacitive element 115 (a gate electrode of a transistor 111 and a source/drain terminal of a transistor 113 connected to the gate electrode of the transistor 111) not connected to the second data line DL2. Turn-on and turn-off states of the transistor 114D is controlled by a scan signal G1 supplied from a first gate line GL1. The transistor 114D is a reset transistor for setting a gate voltage Vg of the transistor 111 with an initial voltage Vinit (for an initialization operation). In exemplary embodiments, initialization is made as both ends of the capacitive element 115 are shorted when the initial voltage Vinit is supplied to the second data line DL2. Also, the transistor 113 is turned off at initialization.

(First Modified Embodiment)

Embodiments are exemplified as a driving circuit and a driving method are applied to an electronic device 1 and an optoelectronic device 10. However, embodiments may be implemented as a driving circuit. In this case, the driving circuit may include pixel circuits arranged in a matrix and a circuit for making a current light-emitting element emit light on the basis of a data line, a gate line, and a light-emitting control line. The driving circuit may further include a data line control circuit, a light-emitting control circuit, a gate line control signal, and so on.

(Second Modified Embodiment)

Each of the above-described demultiplexers 41 and 41B is formed of two blocks. However, embodiments are not limited thereto. For example, each of the above-described demultiplexers 41 and 41B may be formed of more blocks or one block.

(Third Modified Embodiment)

An embodiment is exemplified as each of the above-described components is formed of p-type transistors. However, embodiments are not limited thereto. For example, each of the above-described components may be formed of p-type transistors or a combination of p-type and n-type transistors.

In any case, the circuit may not be directly applied. However, a driving circuit and a driving method may be modified or changed into an implementable circuit.

(Fourth Modified Embodiment)

In the above-described embodiment, a plurality of data lines provided to correspond to each column of pixel circuits 110 may be connected with a plurality of pixel circuits 110, and this interconnection may be decided according to a predetermined rule.

For example, when two data lines are used for each column of pixel circuits, a pixel circuit 110 connected to a first data line and a pixel circuit 110 connected to a second data line may be connected alternately per row, per two rows, or by any other configuration. For example, a plurality of pixel circuits 110 are exclusively connected to each of n data lines in a column.

By way of summation and review, embodiments are directed to improving the quality of display by securing a light-emitting time and increasing time available to write data voltages at pixel circuits of one row. In particular, by providing n (n being an integer of 2 or more) data lines for each column and dividing rows into n groups, e.g., odd and even when n is 2, data may be written independently for each row within a group, while allowing light emission for written rows of different groups. In other words, writing does not need to be completed for all pixel circuits before light is emitted.

In contrast, other techniques for compensating for variation of the driving transistor may include supplying current to the current light-emitting element after writing of data voltages at all pixel circuits is terminated. As a consequence of driving performed as described above, pixel circuits of all rows are written during the first half of one frame and light-emitting is made during the last half thereof. In this case, a time when data voltages are written at pixel circuits of one row is (1 FP−LEP)/NR (1FP being 1 frame period, LEP being light-emitting period, and NR being the number of rows), which may result in insufficient write time and in a decrease in the degree of accuracy of a gray scale. Also, compensation may be insufficient, because time taken to compensate for a variation in a threshold voltage of a driving transistor is decreased. Moreover, influence of such variation may appear at a display image in a screen as mura.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A device, comprising:

a plurality of pixel circuits arranged in a matrix having columns and rows, the pixel circuits to supply light-emitting currents to light-emitting elements according to data voltages being written;

a plurality of data lines including n data lines (n being an integer of 2 or more) extending along each column, wherein the n data lines include first and second data lines being respectively connected to first and second pixel circuits in a same column and selectively receiving the data voltages and an initial voltage;

a plurality of gate lines to supply scan signals to the plurality of pixel circuits; and a plurality of light-emitting control lines to supply light-emitting control signals indicating whether to supply the light-emitting currents of the plurality of pixel circuits, and wherein each pixel circuit includes:

a driving transistor to control an amount of a light-emitting current to be supplied to a light-emitting element in response to a data voltage;

a write control transistor to control whether gate and drain electrodes of the driving transistor are electrically connected in response to a scan signal;

a light-emitting control transistor between the driving transistor and the light-emitting element, the light-emitting control transistor to control whether to supply the light-emitting current to the light-emitting element in response to a light-emitting control signal;

a capacitive element between a data line and the gate electrode of the driving transistor, the capacitive element to retain the data voltage; and a reset transistor to set the gate electrode of the driving transistor with the initial voltage before storing the data voltage to the capacitive element, and wherein when a light-emitting element of the first pixel circuit in the same column emits light, the second pixel circuit in the same column receives the data voltage through the second data line and the first pixel circuit receives the initial voltage through the first data line, and when a light-emitting element of the second pixel circuit in the same column emits light, the first pixel circuit in the same column receives the data voltage through the first data line and the second pixel circuit receives the initial voltage through the second data line.

2. The device as claimed in claim 1, further comprising:

a data line control circuit to control the data voltages; and a light-emitting control circuit to control the light-emitting control signals, wherein, when the data voltage is supplied to one of the n data lines, the data line control circuit supplies the initial voltage to remaining data lines of the n data lines, and wherein the light-emitting control circuit performs a control operation such that a light-emitting control transistor of the first pixel circuit supplied with the first data voltage and a light-emitting control transistor of a third pixel circuit in the same column, of which a gate electrode of a driving transistor being set with the initial voltage, stop supplying light-emitting currents thereof, and a light-emitting control transistor of the second pixel circuit supplies a light-emitting current thereof.

3. The device as claimed in claim 1, wherein a gate electrode of a write control transistor of a pixel circuit disposed in a first row and a gate electrode of a reset transistor of a pixel circuit disposed in a second row immediately adjacent to the first row are connected to the same gate line.

4. The device as claimed in claim 1, wherein both ends of the capacitive element are shorted by turning on the reset transistor and the write control transistor.

5. The device as claimed in claim 1, wherein both ends of the capacitive element are shorted by turning on the reset transistor.

6. The device as claimed in claim 1, wherein n is 2, pixel circuits in an odd-numbered row are connected to the first data line and pixel circuits of an even-numbered row are connected to the second data line.

7. The device as claimed in claim 1, wherein the data voltage corresponds to a gray scale, the device further comprising a controller to control the gray scale.

8. The device as claimed in claim 1, wherein when the light-emitting element of the first pixel circuit in the same column emits light, a gate electrode of a driving transistor of a third pixel circuit in the same column is set with the initial voltage through the first data line, the third pixel being connected to the first data line.

9. A method of driving a device that includes a plurality of pixel circuits arranged in a matrix having columns and rows, a plurality of data lines including n data lines (n being an integer of 2 or more) extending along each column, wherein the n data lines include first and second data lines being respectively connected to first and second pixel circuits in a same column and selectively receiving the data voltages and an initial voltage, a plurality of gate lines for supplying scan signals to the plurality of pixel circuits, and a plurality of light-emitting control lines, the method comprising:

supplying a data voltage to the second pixel circuit through the second data line and supplying the initial voltage to the first pixel circuit through the first data line when a light-emitting element of the first pixel circuit emits light, and supplying a data voltage to the first pixel circuit through the first data line and supplying the initial voltage to the second pixel circuit through the second data line when a light-emitting element of the second pixel circuit emits light.

10. The method as clamed in claim 9, further comprising initializing and writing each pixel circuit independently.

11. The method as clamed in claim 9, further comprising emitting light from at least one pixel circuit in each of the plurality of pixel circuits, the at least one pixel circuit being connected to a data line not supplied with the data voltage.

12. The method as claimed in claim 11, further comprising writing at least one pixel circuit connected to the data line supplied with the data voltage and turning off remaining pixels in the plurality of pixels circuits including the at least one pixel circuit being written.

13. The method as claimed in claim 12, further comprising, once all pixel circuits have been written, alternating off and light emitting states between the plurality of pixel circuits.

14. The method as claimed in claim 12, further comprising setting a gate electrode of a driving transistor of a third pixel circuit in the same column with the initial voltage through the first data line when the light-emitting element of the first pixel circuit in the same column emits light.

15. A device, comprising:

a plurality of pixel circuits arranged in a matrix having columns and rows;

a plurality of data lines including n data lines(n being an integer of 2 or more) extending along each column, wherein the n data lines include first and second data lines being respectively connected to first and second pixel circuits in a same column and selectively receiving a data voltage and an initial voltage;

a plurality of gate lines to supply scan signals to the plurality of pixel circuits; and a plurality of light-emitting control lines to supply light-emitting control signals indicating whether to supply light-emitting currents of the plurality of pixel circuits, wherein the second data line supplies the data voltage to the second pixel circuit and the first data line supplies the initial voltage to the first pixel circuit when a light-emitting element of the first pixel circuit emits light, and the first data line supplies the data voltage to the first pixel circuit and the second data line supplies the initial voltage to the second pixel circuit when a light-emitting element of the second pixel circuit emits light.

* * * * *